US007716892B2

(12) United States Patent
Kim

(10) Patent No.: US 7,716,892 B2
(45) Date of Patent: May 18, 2010

(54) CEILING PANEL SYSTEM

(76) Inventor: Kwon Hee Kim, 206-302, Jugong Apt., 503 Daebang-Dong, Dongjak-Gu, Seoul, 156-765 (KR)

( * ) Notice: Subject to any disclaimer, the term of this patent is extended or adjusted under 35 U.S.C. 154(b) by 139 days.

(21) Appl. No.: 11/921,650

(22) PCT Filed: Jun. 14, 2006

(86) PCT No.: PCT/KR2006/002271

§ 371 (c)(1),
(2), (4) Date: Dec. 6, 2007

(87) PCT Pub. No.: WO2006/135193

PCT Pub. Date: Dec. 21, 2006

(65) Prior Publication Data

US 2009/0126295 A1 May 21, 2009

(30) Foreign Application Priority Data

Jun. 15, 2005 (KR) ..... 10-2005-0051468

(51) Int. Cl.
*E04B 9/06* (2006.01)
*E04B 1/82* (2006.01)
*E04F 13/00* (2006.01)
*E04F 13/08* (2006.01)

(52) U.S. Cl. ..... 52/506.08; 52/506.05; 52/782.1; 52/311.1

(58) Field of Classification Search ..... 52/311.1, 52/311.2, 392, 314, 506.01, 506.05, 506.08
See application file for complete search history.

(56) References Cited

U.S. PATENT DOCUMENTS

| | | | | | |
|---|---|---|---|---|---|
| 78,218 | A | * | 5/1868 | Marshall | 52/311.1 |
| 2,704,864 | A | * | 3/1955 | Miles | 52/145 |
| 2,796,636 | A | * | 6/1957 | Heerwagen | 52/144 |
| 3,234,692 | A | * | 2/1966 | Knud | 52/392 |
| 3,628,297 | A | * | 12/1971 | Richardson | 52/267 |
| 4,189,888 | A | * | 2/1980 | Blitzer, Jr. | 52/506.07 |
| 4,951,443 | A | * | 8/1990 | Caferro | 52/506.07 |
| 5,014,479 | A | * | 5/1991 | Yeh et al. | 52/308 |
| D330,259 | S | * | 10/1992 | Nemchock | D25/58 |
| 5,241,798 | A | * | 9/1993 | Platt et al. | 52/311.2 |
| 5,406,763 | A | * | 4/1995 | Al-Saleh | 52/311.1 |
| 5,590,500 | A | * | 1/1997 | McCue | 52/311.2 |
| 5,836,127 | A | * | 11/1998 | Clark et al. | 52/506.07 |

* cited by examiner

*Primary Examiner*—David Dunn
*Assistant Examiner*—Joseph J. Sadlon
(74) *Attorney, Agent, or Firm*—GWiPS

(57) ABSTRACT

A ceiling panel system is developed that comprises a ceiling panel having a face portion with four corner areas and a skirt portion extending rearward from the face portion. The face portion has a main decorative hole with a peripheral edge from which a main flange portion extends rearward. The corner areas of the face portion has first to fourth subordinate decorative holes with a peripheral edge from which first to fourth subordinate flange portion extends rearward. A main decorative object is fitted to the main decorative hole so as to protrude from the face portion of the ceiling panel. The clips are adapted to grip the main flange portion for the main decorative object and the subordinate flange portions for the subordinate decorative objects.

10 Claims, 11 Drawing Sheets

CEILING PANEL SYSTEM

BACKGROUND OF THE INVENTION

1. Field of the Invention

The present invention is directed to a ceiling panel system and, more specifically, to a ceiling panel system that can give a three-dimensional look to a plurality of ceiling panels arranged in a lattice pattern on an arbitrary horizontal plane.

2. Related prior Art

In an effort to conceal cables, ducts, pipes and so forth, an access ceiling is installed under the roof of an office building, a subway station building, a factory building or the like. The access ceiling is completed by a wide variety of finishes such as ceiling panels or boards. For firm installation of the ceiling panels, they should be fixedly secured to an upper structural body by tightening screws or bolts or welding. However, the task of installing the ceiling panels by such a tightening or welding operation requires a great deal of manpower and time and therefore is unsuitable for application to an access ceiling of a subway station building in which maintenance or repair for a piping and a wiring has to be performed from time to time.

A great number of prior art references, including U.S. pat. Nos. 5,603,193, 6,205,733 and 6,230,463, disclose techniques for installing a plurality of ceiling panels to a ceiling structural body on an arbitrary horizontal plane. As disclosed in these references, a plurality of grids are attached to the ceiling structural body and rectangular ceiling panels are secured to the grids in the form of cross stripes. The prior art ceiling panel systems noted above pose a problem in that they suffer from significant reduction in an ornamental effect, because the rectangular ceiling panels are monotonously arranged in a lattice pattern on the arbitrary horizontal plane.

In the meantime, the ceiling panels are made of varying kinds of materials such as wooden plates, veneer boards, gypsum boards, metal plates or the like. In view of the fact that vibration and impulse act continuously on the ceiling panels of a subway station building or a factory building, the ceiling panel materials should exhibit rigidity, wear resistance and anti-corrosion property great enough to resist the vibration and impulse. Thus, metal plates have been mainly used as the ceiling panels for that purpose. Although the ceiling panels made of metal plates are produced by a sheet metal working, the intrinsic features of the sheet metal working make it quite difficult to form the ceiling panels into diversified shapes.

SUMMARY OF THE INVENTION

Taking into account the above and other problems inherent in the prior art, it is an object of the present invention to provide a ceiling panel system that, while arranging a plurality of ceiling panels in a lattice pattern on an arbitrary horizontal plane, can give a three-dimensional look to the ceiling panels and can improve an ornamental effect thereof.

Another object of the present invention is to provide a ceiling panel system capable of giving a variety of three-dimensional looks to individual ceiling panels.

A further object of the present invention is to provide a ceiling panel system that has a simplified structure and is easy to install.

With these objects in view, the present invention provides a ceiling panel system, comprising: a ceiling panel lying on an arbitrary horizontal plane and including a rectangular face portion with four corner areas and a skirt portion extending rearward from a peripheral edge of the face portion, the face portion having at least one main decoration hole with a peripheral edge from which a main flange portion extends rearward, the corner areas of the face portion having first to fourth subordinate decoration holes with peripheral edges from which first to fourth subordinate flange portions extend rearward; a main decoration object fitted to the main decoration hole in such a manner as to protrude from the face portion of the ceiling panel, the main decoration object including a face portion and a skirt portion extending rearward from a peripheral edge of the face portion of the main decoration object; subordinate decoration objects fitted to the subordinate decoration holes in such a manner as to protrude from the face portion of the ceiling panel, each of the subordinate decoration objects including a face portion and a skirt portion extending rearward from a peripheral edge of the face portion of each of the subordinate decoration objects; and a fixing means for joining together the main flange portion and the skirt portion of the main decoration object and for joining together the first to fourth subordinate flange portions and the skirt portions of the subordinate decoration objects.

BRIEF DESCRIPTION OF THE DRAWINGS

The above and other objects, features and advantages of the present invention will become apparent from the following description of preferred embodiments given in conjunction with the accompanying drawings, in which.

DETAIL DESCRIPTION OF THE PREFERRED EMBODIMENTS

Figure 1:
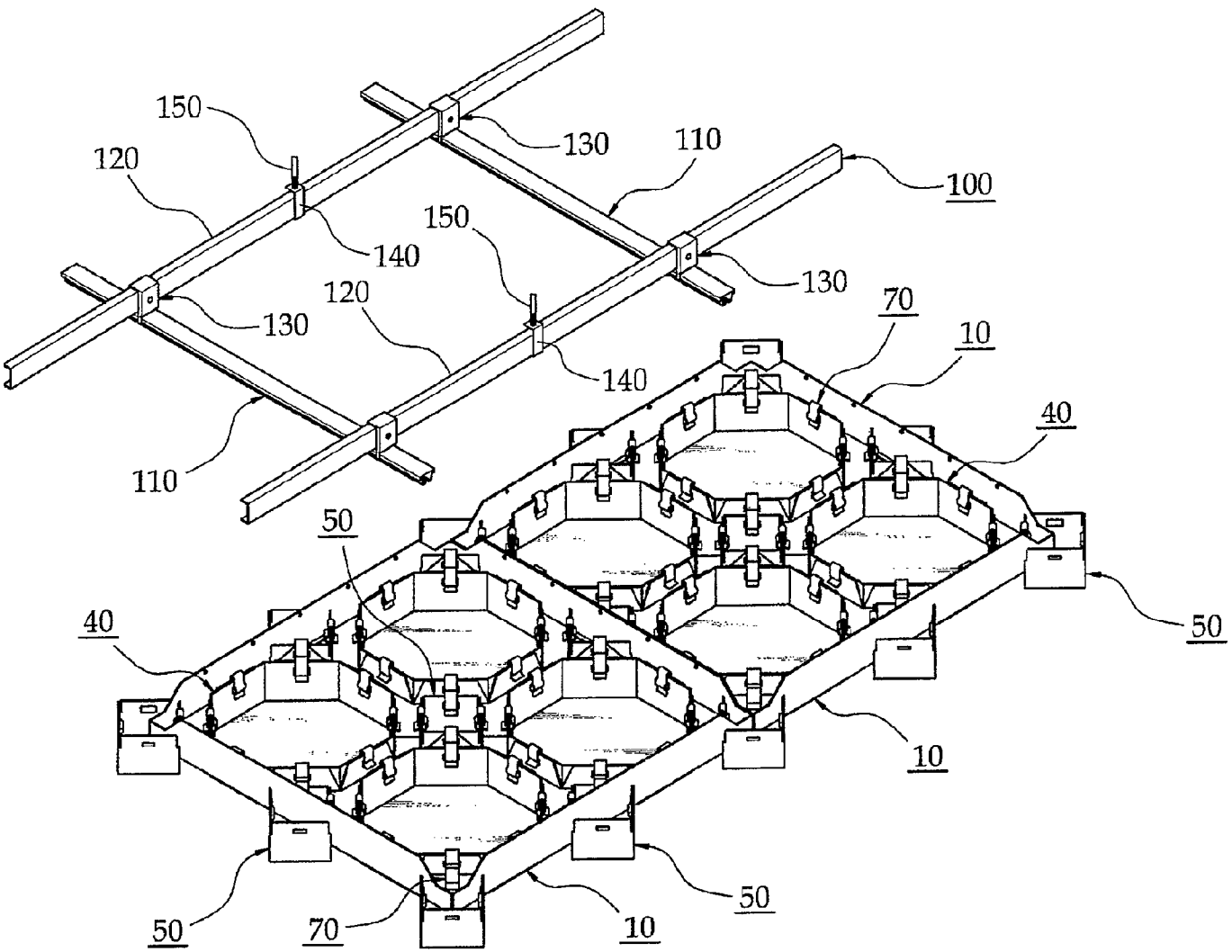
FIG. 1 is a perspective view showing the overall configuration of a ceiling panel system in accordance with the present invention.

One preferred embodiment of a ceiling panel system according to the present invention will now be described in detail with reference to the accompanying drawings.

Referring first to FIGS. 1 through 9, a ceiling panel system of the present invention includes a plurality of ceiling panels 10 attached to a roof of an office building, a subway station building, a factory building or the like in a mutually adjoining relationship to provide an access ceiling installation for example, each of the ceiling panels 10 arranged in a lattice pattern on an arbitrary horizontal plane. The ceiling panels 10 are produced by sheet-metal-working metal plates. Each of the ceiling panels 10 is comprised of a rectangular face portion 14 with four corner areas 12 and a skirt portion 16 extending rearward from the peripheral edge of the face portion 14.

As shown in FIGS. 6 through 9, one or more main decoration holes 18 are formed in the face portion 14 of each of the ceiling panels 10 and a main flange portion 20 protrudes rearward from the peripheral edge of each of the main decoration holes 18. Although four main decoration holes 18 are formed in all directions about the center of the face portion 14 in FIGS. 8 and 9, the number and position of the main decoration holes 18 may be properly increased or decreased if necessary. Only one main decoration hole may be formed at the center of the face portion 14. While each of the main decoration holes 18 of the ceiling panels 10 is shown to have an octagonal shape in FIGS. 8 and 9, this is for the illustrative purpose only and, therefore, each of the main decoration holes 18 may be changed to many other shapes, e.g., a circle, an ellipse, a triangle, a rectangle, a pentagon and a hexagon.

Figure 6:
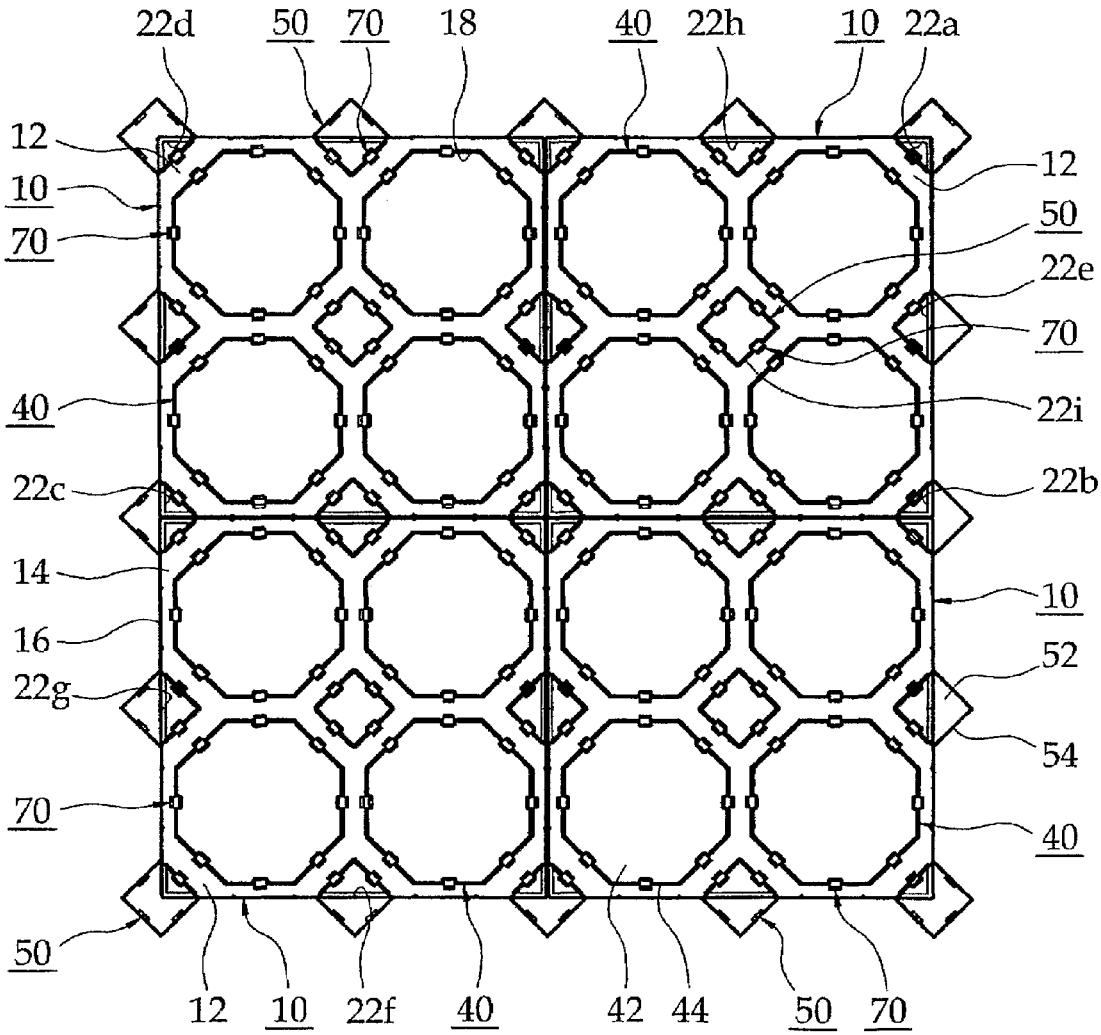
FIG. 6 is a plan view illustrating one exemplary configuration of four ceiling panels of the inventive ceiling panel system arranged adjacent to one another.
Figure 8:
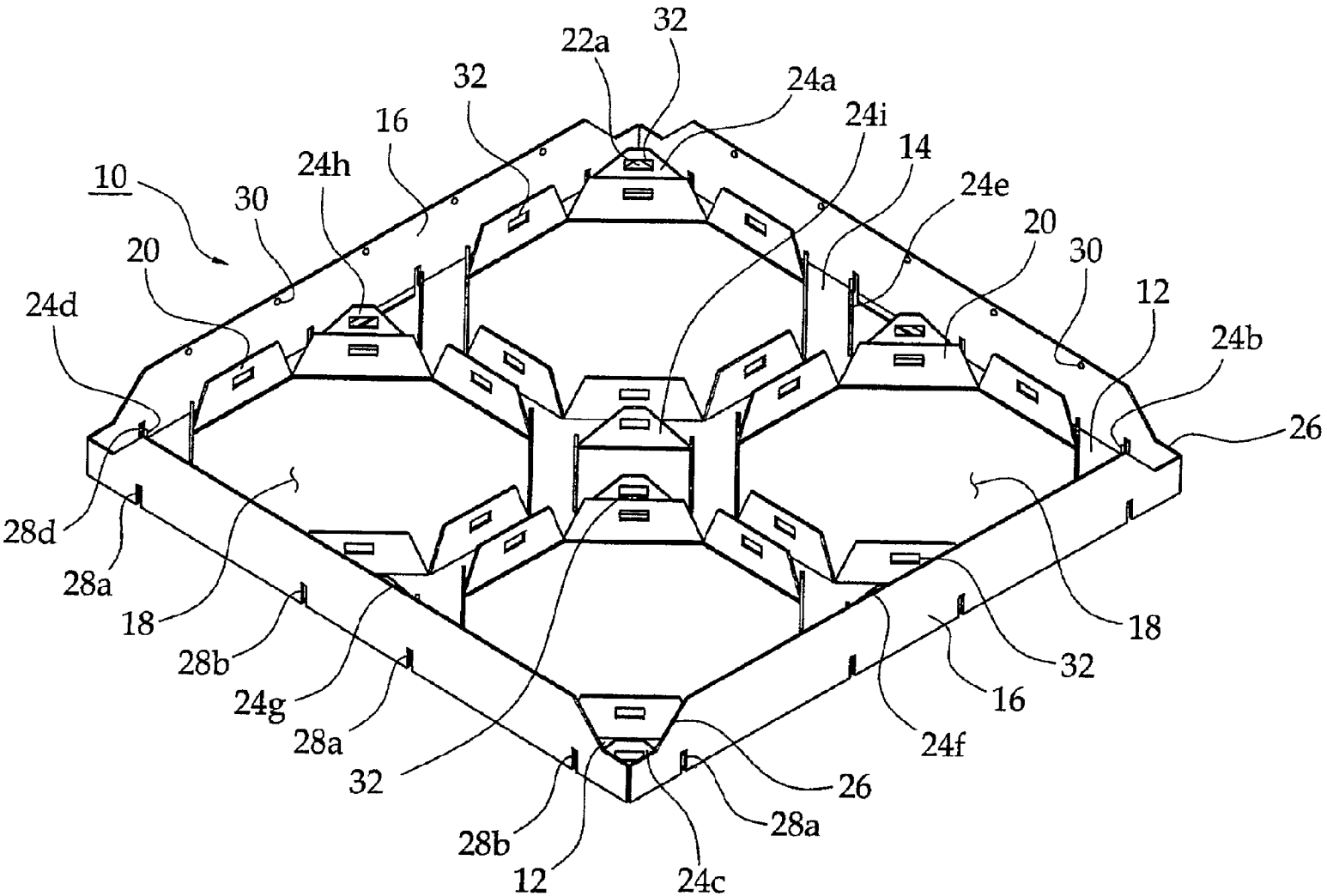
FIG. 8 is a top perspective view showing the configuration of a ceiling panel employed in the ceiling panel system of the present invention.
Figure 9:
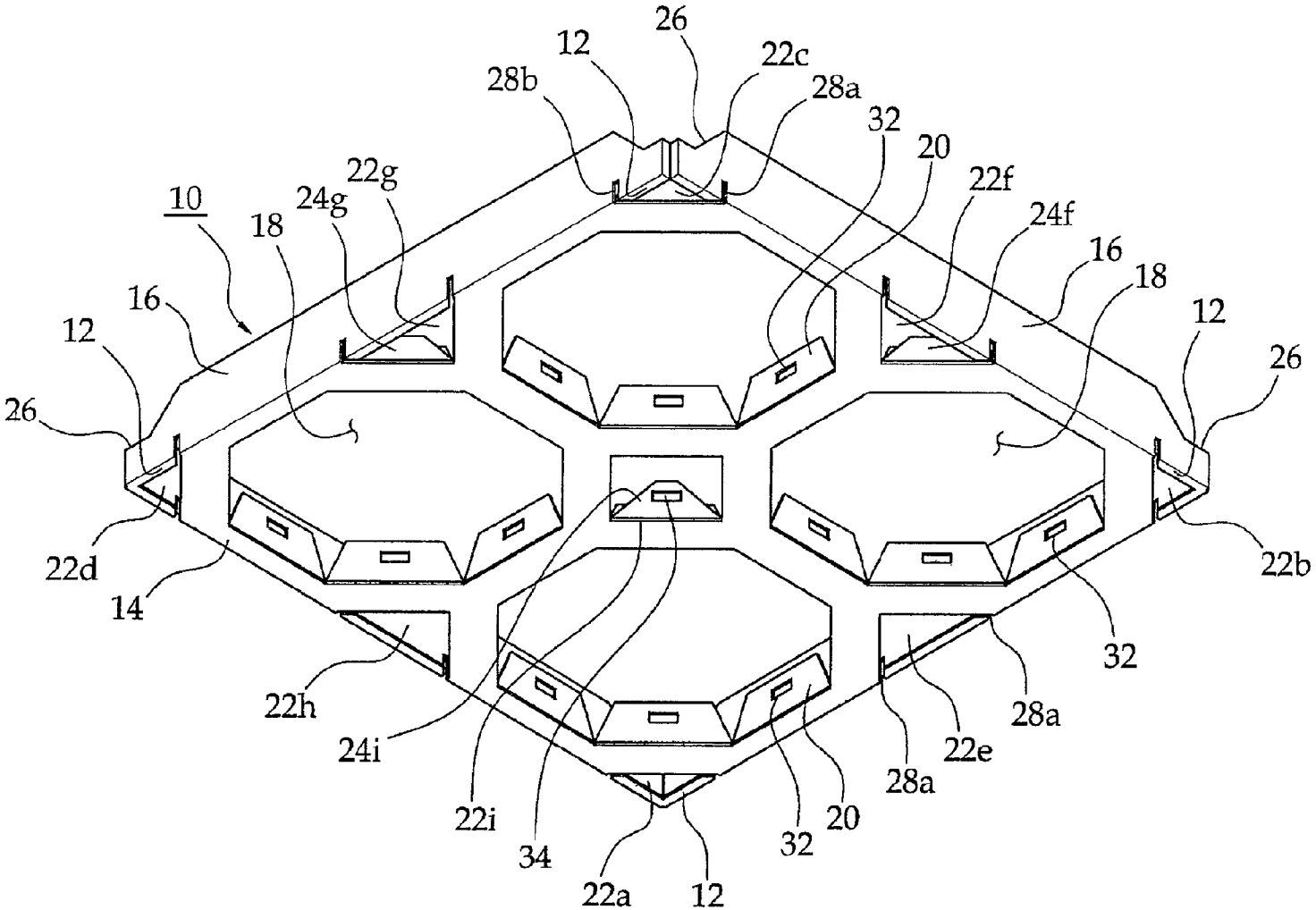
FIG. 9 is a bottom perspective view showing the configuration of a ceiling panel employed in the ceiling panel system of the present invention.

As illustrated in FIGS. 6, 8 and 9, first to fourth subordinate decoration holes 22*a*-22*d* are formed at the respective corner areas 12 of the face portion 14 of the ceiling panels 10, and fifth to eighth subordinate decoration holes 22*e*-22*h* are formed at the middle of each of the side edges of the face portion 14. First to eighth subordinate flange portions 24*a*-24*h* extend rearward respectively from one side edge of the first to eighth subordinate decoration holes 22*a*-22*h*. In FIGS. 8 and 9, the first to eighth subordinate decoration holes 22*a*-22*h* are shown to have a triangular shape. If four of the ceiling panels 10 are positioned adjacent to one another, each of the first to fourth subordinate decoration holes 22*a*-22*d* of the four ceiling panels 10 forms a rectangle in cooperation with the ones of the neighboring subordinate decoration holes as viewed from the bottom. If two of the ceiling panels 10 are positioned adjacent to each other, each of the fifth to eighth subordinate decoration holes 22*e*-22*h* of the two ceiling panels 10 forms a rectangle in cooperation with the one of the neighboring subordinate decoration holes as viewed from the bottom. The fifth to eighth subordinate decoration holes 22*e*-22*h* may be changed in shape to a semi-circle, a semi-ellipse, a semi-pentagon, a semi-hexagon, a semi-octagon and so forth.

Provided at the center of the face portion 14 of the respective ceiling panels 10 is a ninth subordinate decoration hole 22*i*, from the peripheral edge of which a ninth subordinate flange portion 24*i* extends rearward. While the ninth subordinate decoration hole 22*i* is shown to have a rectangular shape in FIGS. 8 and 9, this is for the illustrative purpose only and, therefore, the ninth subordinate decoration hole 22*i* may be changed to many other shapes, e.g., a circle, an ellipse, a triangle, a rectangle, a pentagon and a hexagon.

Referring to FIGS. 2-6, 8 and 9, a cutout 26 is formed at each of the four corner areas of the skirt portion 16 and a pair of slits 28*a* and 28*b* are formed at the skirt portion 16 in such a manner as to lead to the opposite ends of each of the first to eighth subordinate decoration holes 22*a*-22*h*. A plurality of protrusions 30 are formed on the inner surface of the skirt portion 16, which protrusions 30 may be created by embossing the skirt portion 16. A plurality of coupling holes 32 are formed on the main flange portion 20 and one or more coupling holes 34 are formed on each of the first to ninth subordinate flange portions 24*a*-24*i*.

Referring to FIGS. 1 through 7, main decoration objects 40 are attached to the main decoration holes 18 of the ceiling panels 10 in such a manner as to protrude forward from the face portion 14. The main decoration objects 40 are produced by sheet-metal-working metal plates just like the ceiling panels 10 or by injection-molding synthetic resin materials. Each of the main decoration objects 40 is comprised of a face portion 42 having the same shape as that of the main decoration holes 18 of the ceiling panels 10 and a skirt portion 44 extending rearward from the peripheral edge of the face portion 42. A plurality of protrusions 46 are formed on the inner surface of the skirt portion 44, which protrusions 46 may be created by embossing the skirt portion 44. As the protrusions 46 are embossed in this manner, a plurality of coupling grooves 48 are left on the outer surface of the skirt portion 44.

Referring to FIGS. 1, 4-7, 10 and 11, subordinate decoration objects 50 are attached to the first to ninth subordinate decoration holes 22*a*-22*i* of the ceiling panels 10. The subordinate decoration objects 50 are produced by sheet-metal-working metal plates just like the ceiling panels 10 and the main decoration objects 40 or by injection-molding synthetic resin materials. Each of the subordinate decoration objects 50 is comprised of a face portion 52 and a skirt portion 54 extending rearward from the peripheral edge of the face portion 52. A plurality of protrusions 56 are formed on the inner surface of the skirt portion 54, which protrusions 56 may be created by embossing the skirt portion 54. As the protrusions 56 are embossed in this manner, a plurality of coupling grooves 58 are left on the outer surface of the skirt portion 54.

At the top ends of the corner areas of the skirt portion 54, four cutouts 60 are formed in alignment with the slits 28*a* and 28*b* of the ceiling panels 10. By aligning two of the four cutouts 60 of the subordinate decoration objects 50 with the slits 28*a* and 28*b* of the ceiling panels 10, the subordinate decoration objects 50 are fitted to the first to eighth subordinate decoration holes 22*a*-22*h* in such a manner that the skirt portions 54 of the subordinate decoration objects 50 can be overlapped with the first to eighth subordinate flange portions 24*a*-24*h* of the ceiling panels 10.

Referring to FIGS. 1-6, 10 and 11, the ceiling panel system of the present invention includes a plurality of clips 70 as a means for coupling together the main flange portions 20 of the ceiling panels 10 and the skirt portion 44 of the main decoration objects 40 and for coupling together the first to ninth subordinate flange portions 24*a*-24*i* of the ceiling panels 10 and the skirt portion 54 of the subordinate decoration objects 50. Each of the clips 70 has a first elastic piece portion 72 and a second elastic piece portion 74 which are spaced apart by a predetermined distance and exhibit elasticity. The top ends of the first elastic piece portion 72 and the second elastic piece portion 74 are connected by means of a connector piece portion 76. Formed on the inner surface of the first elastic piece portion 72 is an engaging piece portion 78 insertedly fitted to each of the coupling holes 32 of the main flange portions 20 and each of the coupling holes 34 of the first to ninth subordinate flange portions 24*a*-24*i*. An engaging groove 80 is formed on the inner surface of the second elastic piece portion 74.

Figure 2:
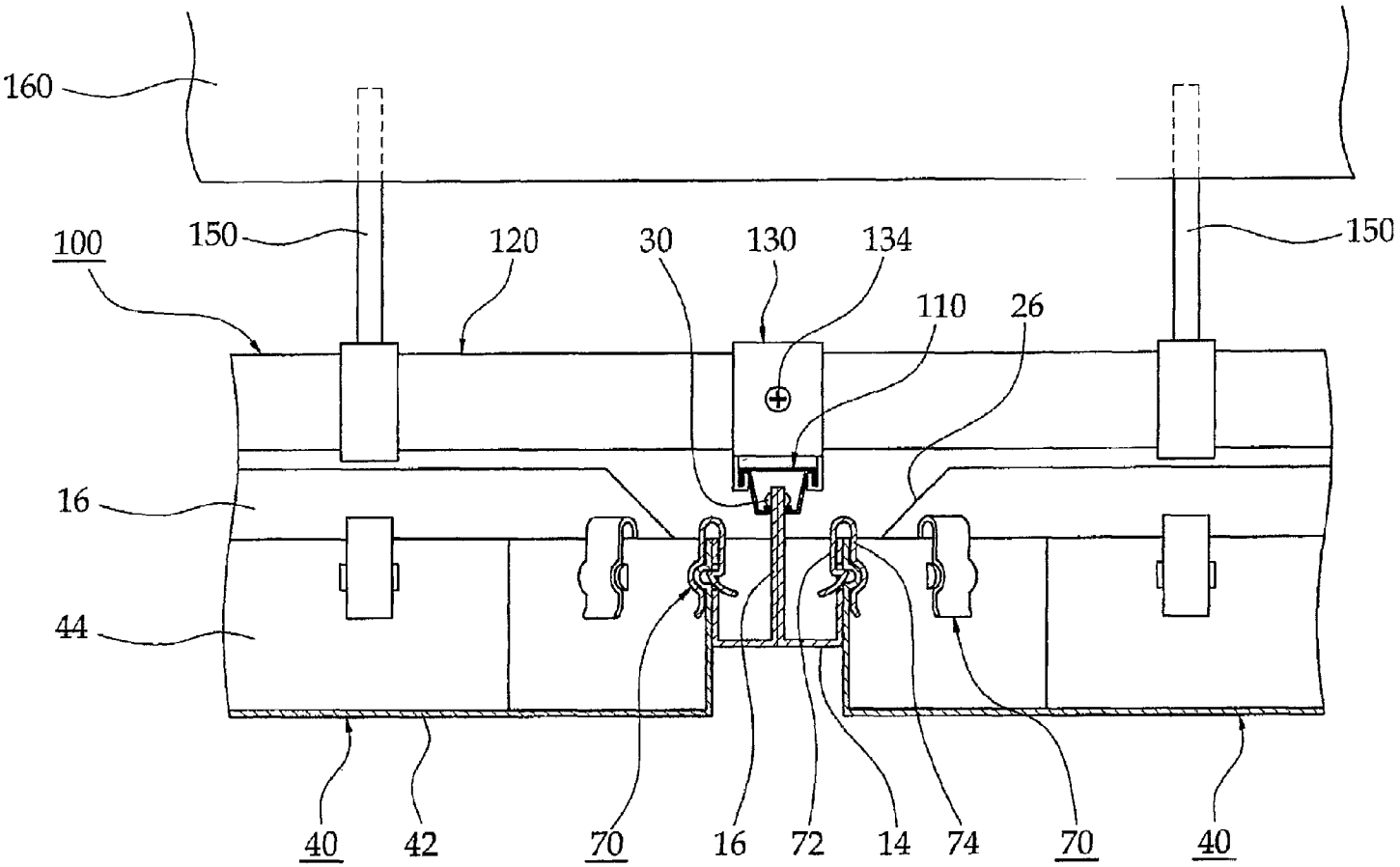
FIG. 2 is a partial cross-sectional view illustrating the configuration of ceiling panels and a frame employed in the ceiling panel system of the present invention.
Figure 3:
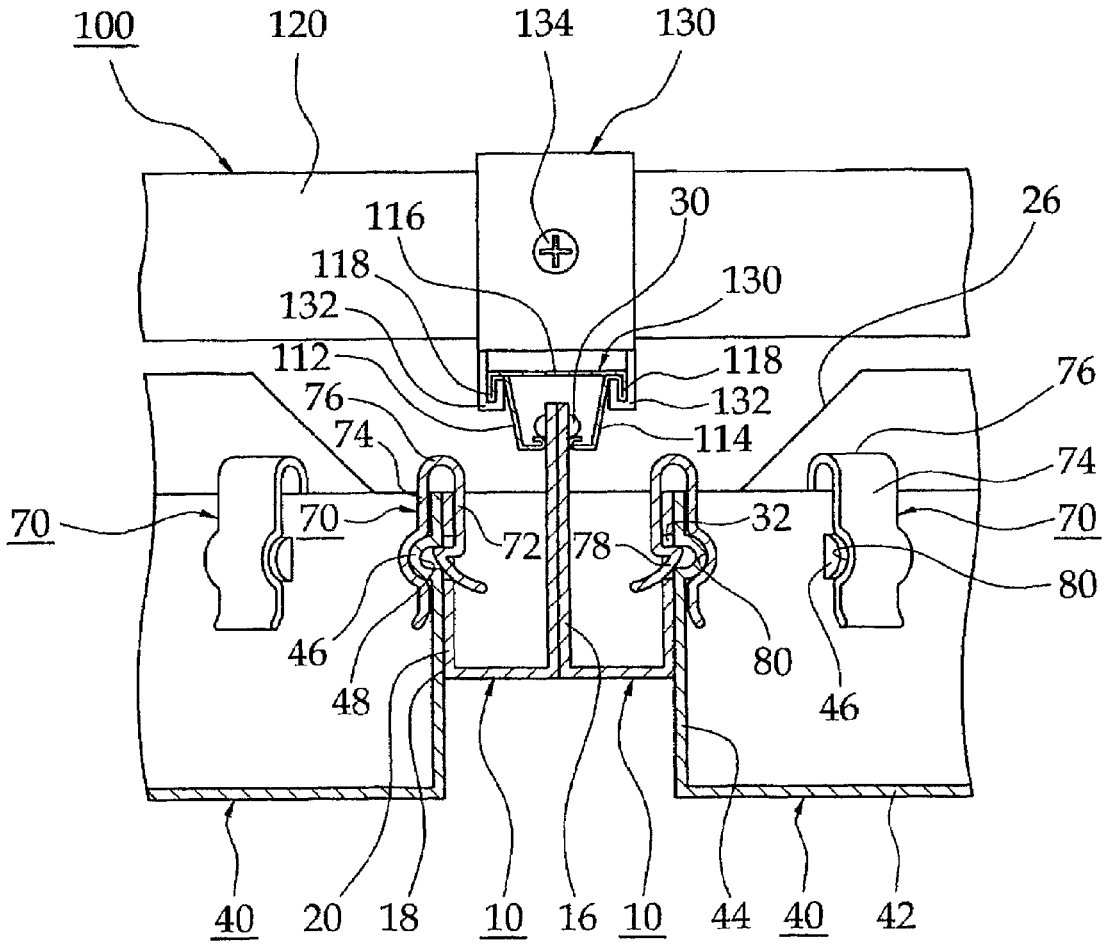
FIG. 3 is a partially enlarged cross-sectional view depicting the combined configuration of ceiling panels, main decoration objects, clips and clip bars employed in the ceiling panel system of the present invention.

Referring to FIGS. 1-3, the ceiling panel system of the present invention includes a frame 100 on which the ceiling panels 10 are installed. The frame 100 is comprised of a plurality of clip bars 110, a plurality of carrying channels 120, a plurality of joint clips 130, a plurality of hangers 140 and a plurality of anchor bolts 150.

The clip bars 110 are arranged above the ceiling panels 10 in a mutually parallel relationship so that the skirt portions 16 of two neighboring ceiling panels 10 can be affixed to the clip bars 110. Each of the clip bars 110 is comprised of a pair of elastic plate portions 112 and 114 having elasticity and pressed against each other so that the skirt portions 16 of the two ceiling panels 10 can be sandwichedly secured between the elastic plate portions 112 and 114, and a connector plate portion 116 adapted to interconnect the top ends of the elastic plate portions 112 and 114. A pair of lugs 118 are formed on the opposite sides of the connector plate portion 116.

The carrying channels 120 are provided on the clip bars 110 in a mutually parallel relationship in such a manner as to intersect the clip bars 110. The clip bars 110 and the carrying channels 120 are secured to each other by the joint clips 130. Each of the joint clips 130 is provided at its bottom opposite sides with a pair of hooks 132 and fastened to the carrying channels 120 by means of a screw 134. The lugs 118 of the clip bars 110 are engaged with the hooks 132 of the joint clips 130.

The hangers 140 are attached to the carrying channels 120 and threadedly coupled to the anchor bolts 150 which in turn are fastened to a ceiling structural body 160, e.g., a concrete slab. If needed, the anchor bolts 150 may be replaced with an anchor wire fixedly secured to the ceiling structural body 160. Instead of using the anchor bolt or the anchor wire, the carrying channels 120 may be directly fastened to the ceiling structural body 160 by means of bolting, welding or other means.

Description will now be given to the operation of the inventive ceiling panel system having the configuration as set forth above.

Referring to FIGS. 1 through 3, in order for a worker to install the ceiling panels 10, the anchor bolts 150 are fastened to the ceiling structural objects 160 and the hangers 140 are secured to the anchor bolts 150. The carrying channels 120 are hung on the hangers 140 and the joint clips 130 are affixed to the carrying channels 120 by tightening the screw 134. The clip bars 110 are attached to the carrying channels 120 in a mutually intersecting relationship by bringing the lugs 118 of the clip bars 110 into engagement with the hooks 132 of the joint clips 130.

Referring to FIGS. 2 through 5, the main decoration objects 40 are insertedly fitted to the main decoration holes 18 of the ceiling panels 10 in such a manner that the main decoration objects 40 protrude forward from the face portion 14. The top ends of the skirt portions 44 are aligned with the top ends of the main flange portions 20 and then the clips 70 are affixed to the main flange portions 20 and the skirt portions 44 from above the ceiling panels 10. Once the main flange portions 20 and the skirt portions 44 are sandwichedly fitted between the first elastic piece portion 72 and the second elastic piece portion 74 of each of the clips 70, the first elastic piece portion 72 and the second elastic piece portion 74 are resiliently biased toward each other to firmly hold the main flange portions 20 and the skirt portions 44 in place. The engaging piece portion 78 of the first elastic piece portion 72 is inserted into the coupling groove 48 through the coupling hole 32, and the protrusions 46 are inserted into the engaging grooves 80 of the second elastic piece portion 74. Thus, the clips 70 firmly hold in place the main decoration objects 40 that are insertedly fitted to the main decoration holes 18 of the ceiling panels 10. Alternatively, the main decoration objects 40 may be secured to the main decoration holes 18 of the ceiling panels 10 by means of a fastener means such as spot welding, bolting, riveting or the like.

Figure 11:
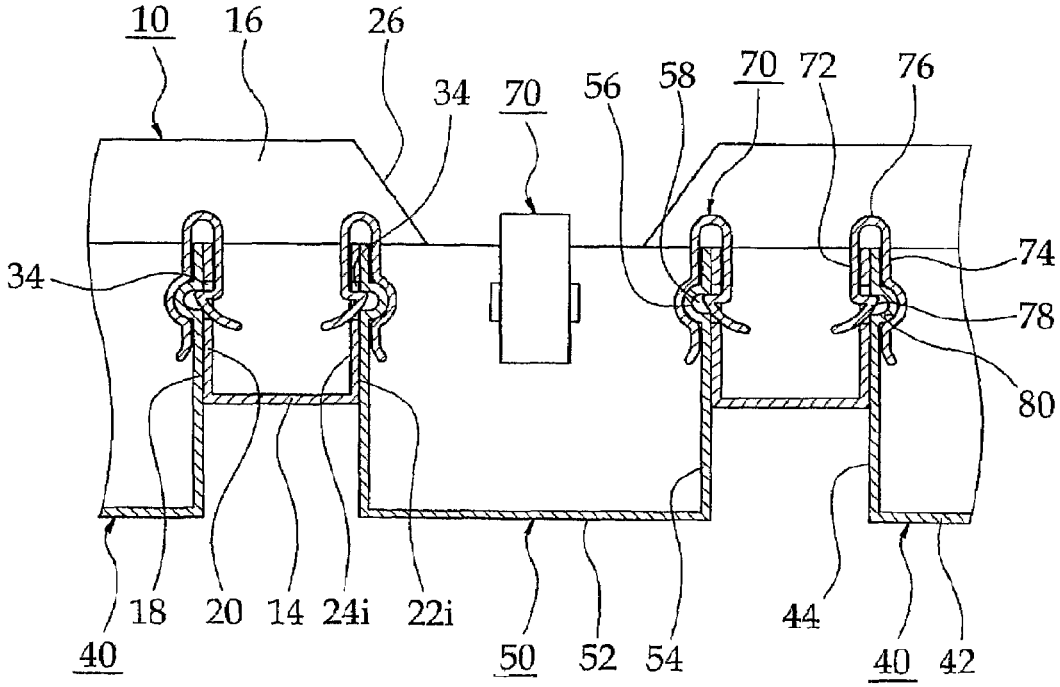
FIG. 11 is a partially enlarged cross-sectional view depicting the configuration of ceiling panels, subordinate decoration objects and clips employed in the ceiling panel system of the present invention.

Referring to FIG. 11, the subordinate decoration object 50 is fitted into the ninth subordinate decoration hole 22*i* of each of the ceiling panels 10 in such a fashion as to protrude forward from the face portion 14. The top end of the skirt portion 54 is aligned with the top end of the ninth subordinate flange portion 24*i* and then the clips 70 are affixed to the ninth subordinate flange portion 24*i* and the skirt portion 54 from above the ceiling panels 10. Once the ninth subordinate flange portion 24*i* and the skirt portion 54 are sandwichedly fitted between the first elastic piece portion 72 and the second elastic piece portion 74 of each of the clips 70, the first elastic piece portion 72 and the second elastic piece portion 74 are resiliently biased toward each other to firmly hold the ninth subordinate flange portion 24*i* and the skirt portion 54 in place. The engaging piece portion 78 of the first elastic piece portion 72 is inserted into the coupling groove 58 through the coupling hole 34, and the protrusions 56 are inserted into the engaging grooves 80 of the second elastic piece portion 74. Thus, the clips 70 firmly hold in place the subordinate decoration object 50 that are insertedly fitted to the ninth subordinate decoration hole 22*i* of the ceiling panels 10.

Referring to FIGS. 2 and 3, the skirt portions 16 of two ceiling panels 10 are overlapped side by side and inserted into between the elastic plate portions 112 and 114 of each of the clip bars 110. As the skirt portions 16 of the two ceiling panels 10 are inserted into between the elastic plate portions 112 and 114 of each of the clip bars 110, the elastic plate portions 112 and 114 are spread apart in the opposite directions to facilitate entry of the overlapped skirt portions 16. Once the protrusions 30 of the skirt portions 16 are inserted through between the elastic plate portions 112 and 114, the distal ends of the elastic plate portions 112 and 114 are resiliently pressed toward each other to firmly hold the skirt portions 16 against removal. At this time, the clip bars 110 are placed at the cutouts 26 of the ceiling panels 10. In this way, the skirt portions 16 of the two ceiling panels 10 are affixed to the clip bars 110 to thereby install the ceiling panels 10 on an arbitrary horizontal plane such that they can be continuously arranged in the front-rear direction and in the left-right direction.

Figure 4:
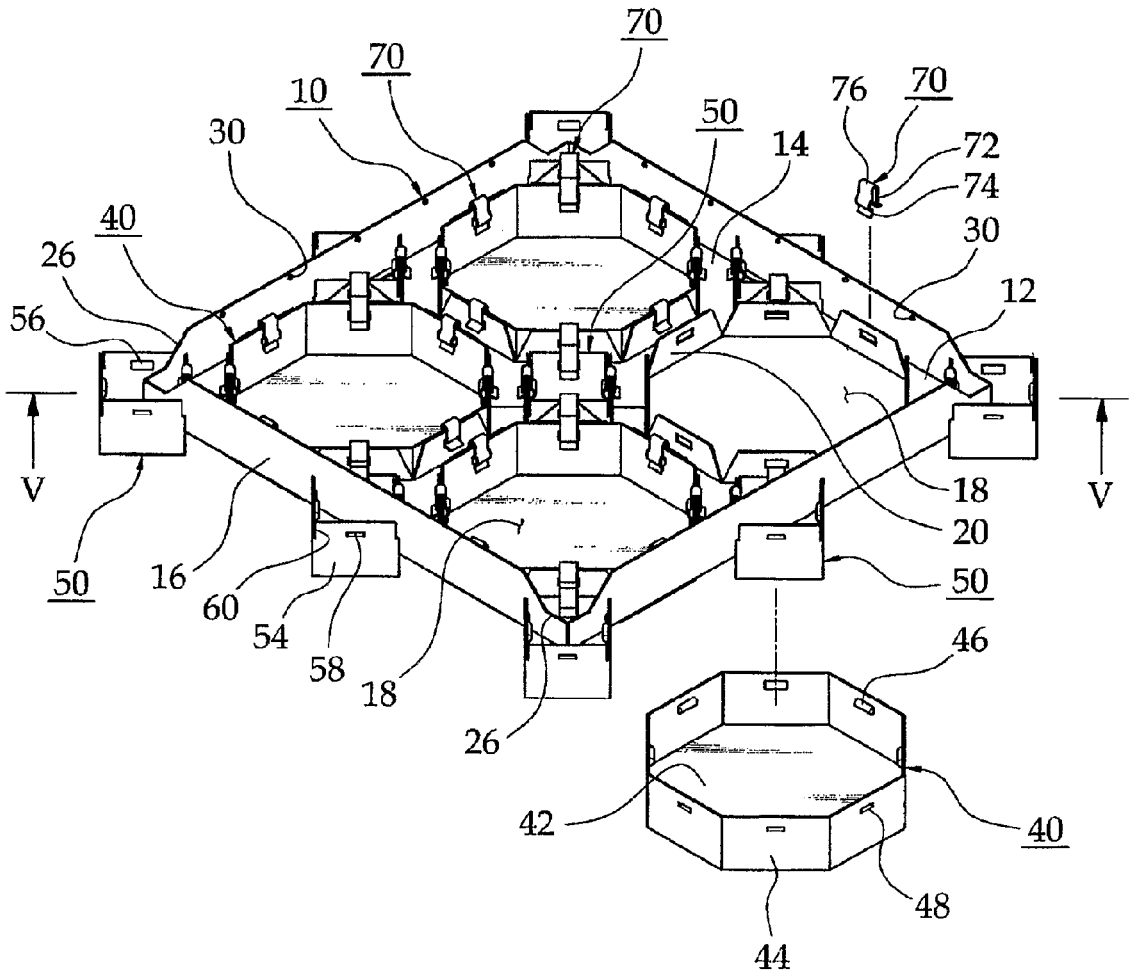
FIG. 4 is a perspective view showing the configuration of ceiling panels, main decoration objects, subordinate decoration objects and clips employed in the ceiling panel system of the present invention.
Figure 5:
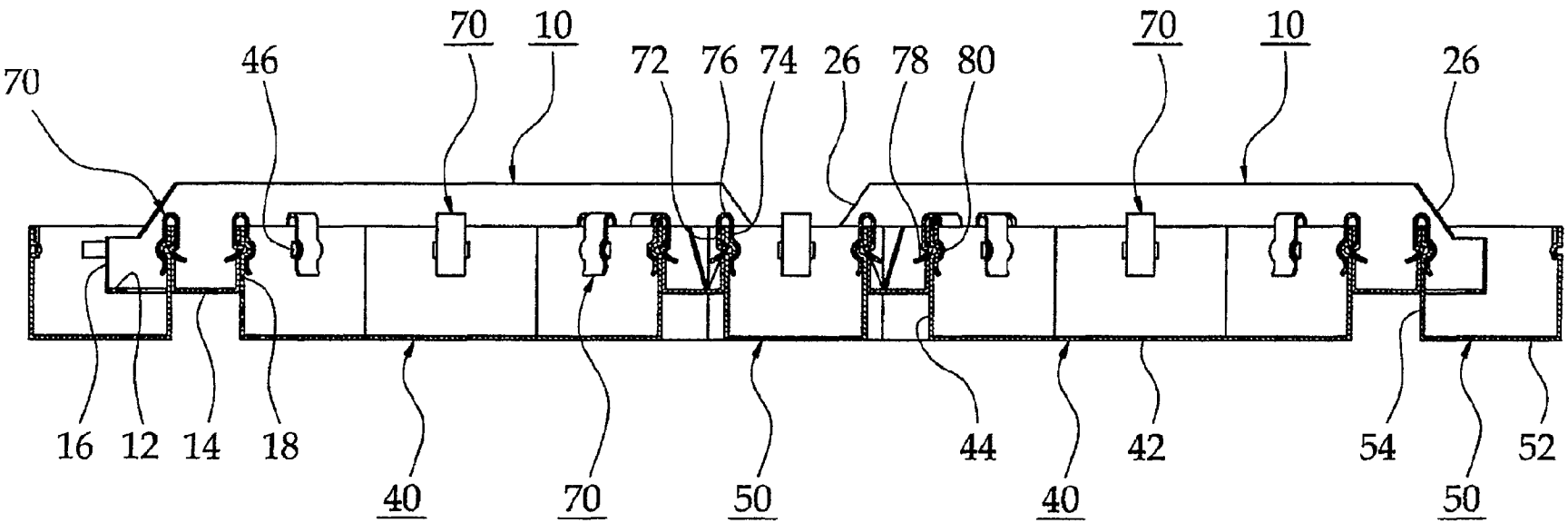
FIG. 5 is a cross-sectional view taken along line V-V in FIG. 4.
Figure 7:
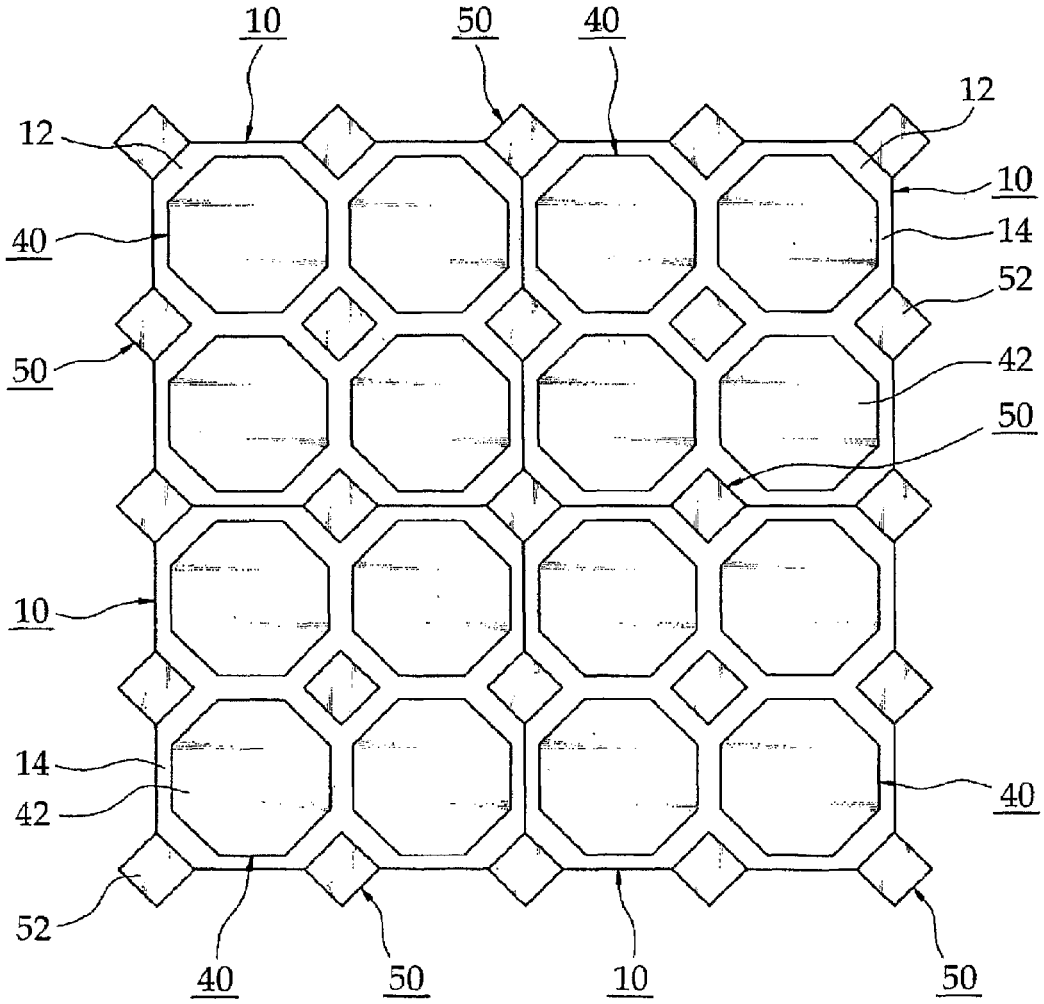
FIG. 7 is a bottom view illustrating one exemplary configuration of four ceiling panels of the inventive ceiling panel system arranged adjacent to one another.
Figure 10:
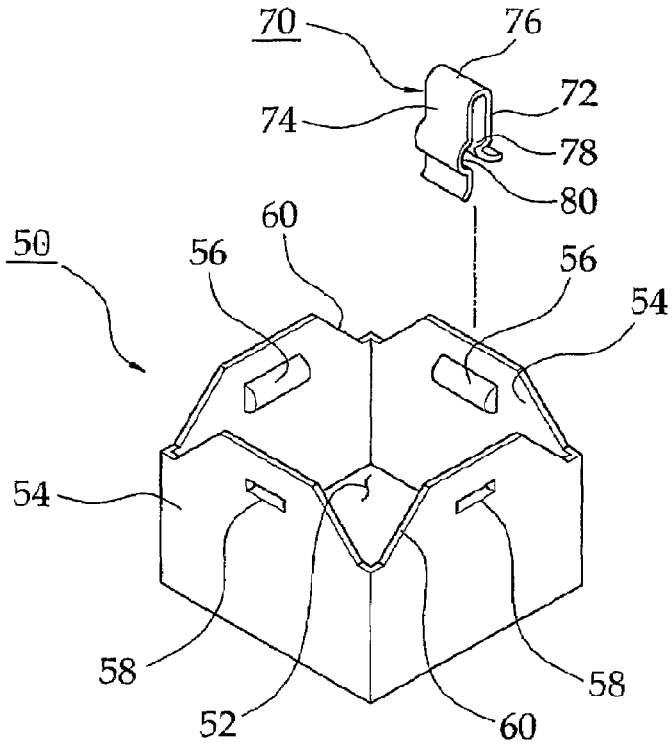
FIG. 10 is a perspective view showing the configuration of an decoration object employed in the ceiling panel system of the present invention.

As illustrated in FIGS. 6 and 7, the subordinate decoration objects 50 are commonly fitted to the first to fourth subordinate decoration holes 22*a*-22*d* of four adjoining ceiling panels 10. Referring to FIGS. 4, 8 and 10, in the process of inserting the subordinate decoration objects 50 into the first to fourth subordinate decoration holes 22*a*-22*d*, the cutouts 60 of the subordinate decoration objects 50 are aligned with the slits 28*a* and 28*b* of the ceiling panels 10 and the top end of the skirt portion 54 is flush with the top end of the first to fourth subordinate flange portions 24*a*-24*d*. Just like the ninth subordinate flange portion 24*i* and the skirt portion 54 set forth earlier, the first to fourth subordinate flange portions 24*a*-24*d* and the skirt portions 54 are insertedly fitted between the first and second elastic piece portions 72 and 74 of the clips 72. Alternatively, the subordinate decoration objects 50 may be secured to the first to ninth subordinate decoration holes 22*a*-22*i* of the ceiling panels 10 by means of a fastener means such as spot welding, bolting, riveting or the like.

As depicted in FIGS. 1, 6 and 7, the subordinate decoration objects 50 are commonly fitted to the fifth to eighth subordinate decoration holes 22*e*-22*h* of two adjoining ceiling panels 10. Referring to FIGS. 4, 8 and 10, in the process of inserting the subordinate decoration objects 50 into the fifth to eighth subordinate decoration holes 22*e*-22*h*, the cutouts 60 of the subordinate decoration objects 50 are aligned with the slits 28*a* and 28*b* of the ceiling panels 10 and the top end of the skirt portion 54 is flush with the top end of the fifth to eighth subordinate flange portions 24*e*-24*h*. The fifth to eighth subordinate flange portions 24*e*-24*h* and the skirt portions 54 are insertedly fitted between the first and second elastic piece portions 72 and 74 of the clips 72.

According to the forgoing arrangement wherein the ceiling panels 10 are attached to the carrying channels 120 of the frame 100 in such a manner as to lie on and protrude from an arbitrary horizontal plane, the main decoration objects 40 are fitted to the ceiling panels 10 to protrude from the face portion 14 and the subordinate decoration objects 50 are fitted to the boundary of the ceiling panels 10, the main decoration objects 40 and the subordinate decoration objects 50 protruding from the ceiling panels 10 can give a three-dimensional look to the ceiling panel system and can greatly improve ornamental effect offered by the ceiling panel system, while allowing the ceiling panels 10 to be arranged on an arbitrary horizontal plane in a lattice pattern. Furthermore, the main decoration objects 40 and the subordinate decoration objects 50 can be readily installed on the ceiling panels 10 using the clips 70, which help to enhance the workability.

Figure 12:
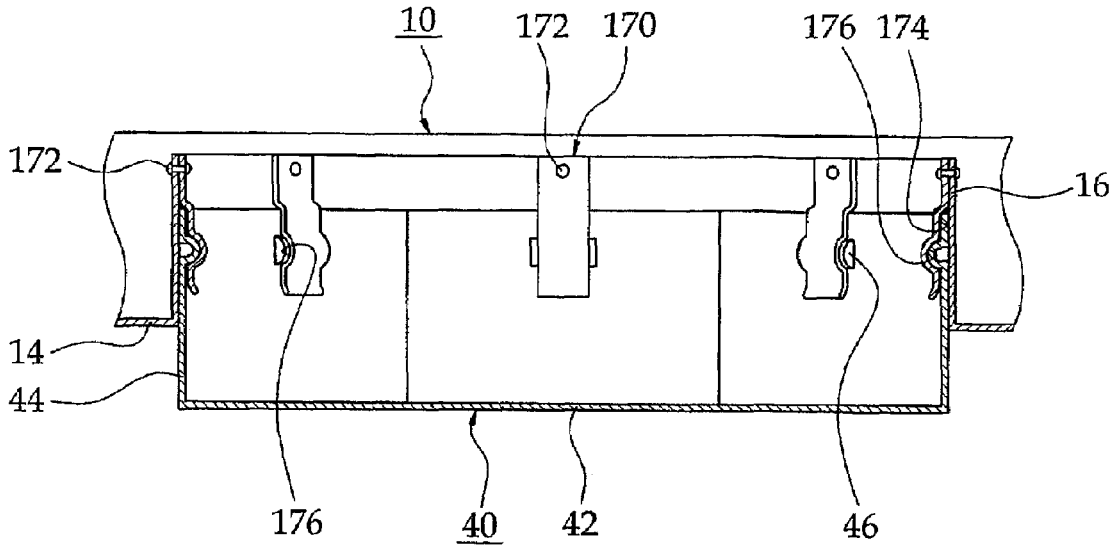
FIG. 12 is a partial cross-sectional view illustrating a main decoration object affixed to ceiling panels by means of a spring plate in the ceiling panel system of the present invention.

FIG. 12 illustrates one main decoration object affixed to ceiling panels by means of a spring plate, one of other examples of a fastener means, in the ceiling panel system of the present invention. Referring to FIG. 12, a plurality of spring plates 170 are attached to the inner top surfaces of the main flange portions 20 of the ceiling panels 10. The top end portion of each of the spring plates 170 is fixed to the main flange portions 20 by means of rivets 172. Alternatively, the top end portion of each of the spring plates 170 may be fixed to the main flange portions 20 by means of spot welding. Each of the spring plates 170 is bent such that a first coupling groove 174 into which the skirt portion 16 of each of the main decoration objects 40 is inserted can be formed between the inner surface of the respective main flange portions 20 and the inner surface of the respective spring plates 170. Formed at the lower extension of each of the spring plates 170 is a second coupling groove 176 into which the protrusion 46 of each of the main decoration objects 40 is inserted.

If the skirt portion 44 of the main decoration object 40 is inserted into the main decoration hole 18 of each of the ceiling panels 10, the top portion of the skirt portion 44 is fitted to the first coupling groove 174 between the inner surface of the respective main flange portions 20 and the inner surface of the respective spring plates 170. The lower extensions of the spring plates 170 are elastically deformed and spaced apart from the inner surface of the respective main flange portions 20, thus facilitating entry of the skirt portion 44. If the protrusion 46 of the main decoration object 40 is inserted into the second coupling groove 176 of the respective spring plates 170, each of the spring plates 170 is resiliently restored to ensure that the skirt portion 44 of the main decoration object 40 is pressed against the main flange portion 20 of each of the ceiling panels 10 and firmly held in place.

According to the above-noted arrangement wherein the spring plates 170 are attached to the main flange portions 20 of the ceiling panels 10 to thereby affix the main decoration objects 40 inserted into the main decoration holes 18 of the ceiling panels 10, it is possible to attach the main decoration objects 40 more easily than in the case where the main flange portions 20 of the ceiling panels 10 are combined with the skirt portions 16 of the main decoration objects 40 by means of the clips 70.

Figure 13:
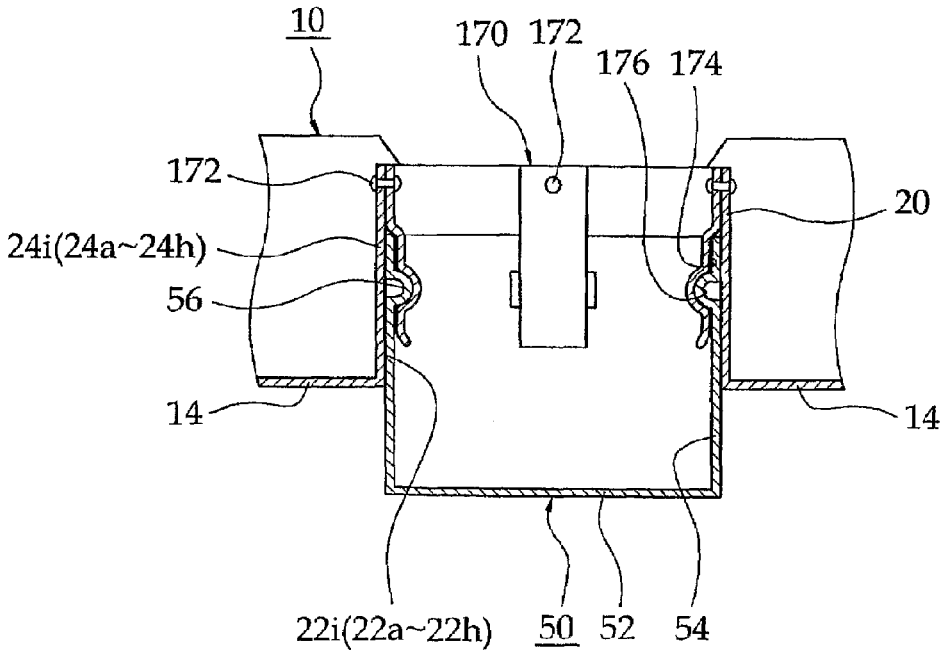
FIG. 13 is a partial cross-sectional view illustrating a subordinate decoration object affixed to ceiling panels by means of a spring plate in the ceiling panel system of the present invention

As shown in FIG. 13, the spring plates 170 are secured to the inner surfaces of the first to ninth subordinate flange portions 24*a*-24*i* of the ceiling panels 10. The subordinate decoration objects 50 are insertedly fitted to the first to ninth subordinate decoration holes 22*a*-22*i* of the ceiling panels 10. The skirt portion 54 of each of the subordinate decoration objects 50 is inserted into the first coupling groove 174 between the inner surface of each of the first to ninth subordinate flange portions 24*a*-24*i* and each of the spring plates 170. The protrusion 56 of each of the subordinate decoration objects 50 is inserted into the second coupling groove 176 of each of the spring plates 170.

While the invention has been shown and described in respect to one preferred embodiment, this is for the illustrative purpose only and is not intended to limit the scope of the invention by no means. It will be understood by those skilled in the art that various changes and modifications may be made without departing from the spirit and scope of the invention as defined in the following claims.

As described in the foregoing, the ceiling panel system of the present invention can give a three-dimensional look to ceiling panels and can improve an ornamental effect thereof, by attaching main decoration objects and subordinate decoration objects to the ceiling panels in such a manner as to protrude from face portions of the ceiling panels while arranging the ceiling panels in a lattice pattern on an arbitrary horizontal plane. Furthermore, the ceiling panel system is capable of giving a variety of three-dimensional looks to the individual ceiling panels by diversifying the shape of the main decoration objects and the subordinate decoration objects. In addition, the ceiling panel system has a simplified structure and is easy to install, thanks to the fact that the main decoration objects and the subordinate decoration objects are combined together by means of clips.

What is claimed is:

1. A ceiling panel system, which is hung under the ceiling of a building structure, said ceiling panel system comprising:

a ceiling panel (10) having four sides, a flat face portion (14) as a base square panel, four skirt portions (16) forming bent-up flanges around each of the four sides of the flat face portion of the ceiling panel (10), four corner areas (12) forming triangular corner-cutout holes (22*a*~22*d*) at four corners of the ceiling panel (10), each triangular corner-cutout hole having subordinate flange portions, a diamond-shaped cutout hole (22*i*) located at a center of the ceiling panel (10) having the bent-up flanges around four sides of the diamond-shaped cutout hole (22*i*), a plurality of octagonal cutout holes (18) being evenly arranged in a 2×2 pattern, each octagonal cutout hole (18) having the bent-up flanges around the octagonal-sides, and four side triangular cutout holes (22*e*~22*h*) disposed at the middle of four sides of the ceiling panel, each side triangular cutout hole having two bent-up flanges around two-sides of the side-triangular cutout hole, a main decorative object (40) forming an octagonal box having a flat face portion and skirt portions of eight bent-up flanges for inserting into the octagonal cutout holes (18), so as to protrude-out from the flat face portion (14) of the ceiling panel (10), a subordinate decorative object (50) forming a square box having a flat face portion and the skirt portions of four bent-up flanges for inserting into the subordinate decoration hole (22), so as to protrude-out from the base flat face portion (14) of the ceiling panel (10), a plurality of clips for clamping the main decorative objects (40) and the subordinate decorative objects (50) to the ceiling panel (10) by snapping the clips into the flange portions and the skirt portions of the main decorative objects, the subordinate flange portions and the ceiling panel (10), and a frame (100) system for hanging the ceiling panels (10) consisting of a plurality of clip bars (110), carrying channels (120), joint clips (130), hangers (140) and anchor bolts (150), wherein the clip bars (110) and the carrying channels (120) are crossing each other to arrange constant intervals for fitting the ceiling panels (10).

2. The ceiling panel system as claimed in claim 1, wherein said triangular corner-cutout holes (22*a*~22*d*) are contacted at a common point of four neighbored ceiling panels to form a complete diamond-shaped cutout hole via cross-borders of the four neighbored ceiling panels for inserting the subordinate decorative object (50).

3. The ceiling panel system as claimed in claim 1, wherein said side triangular cutout holes (22*e*~22*h*) are contacted to the side of neighbored ceiling panels to form a complete diamond-shaped cutout hole via cross-borders of the neighbored ceiling panels for inserting the subordinate decorative object (50).

4. The ceiling panel system as claimed in claim 1, wherein said clips is further comprising a front elastic strip (74) and a rear elastic strip (72) integrally attached to a connection head (76) by a predetermined gap for exerting resilient forces between the bent up flanges (20, 24) and skirt portions (44, 54) of the main decorative objects (40), subordinate decorative objects (50) and ceiling panels (10), wherein the front elastic strip (74) has a half circular-shaped gripping portion (80) and the rear elastic strip (72) has a sickle-shaped hook portion (78) for latching.

5. The ceiling panel system as claimed in claim 1, wherein said main flange portion (20) and the subordinate flange portions (24*a*~24*h*) of the ceiling panel have formed a plurality of slots (32, 34), and the skirt portions (44, 54) of the main decorative objects (40) and the subordinate decorative objects (50) have formed a plurality of grooves (48, 58) and protrusions (46, 56), so that the slots (32, 34) of the subordinate bent up flange portions are aligned to the grooves (48, 58) and protrusions (46, 56) of the skirt portions for snapping-in the clips.

6. The ceiling panel system as claimed in claim 5, wherein the protrusion (46, 56) are formed on the inside of the main decorative objects (40) and the subordinate decorative objects (50), and the grooves (48, 58) are formed opposite side of the protrusions (46, 56).

7. The ceiling panel system as claimed in claim 1, wherein said triangular corner cutout holes (22*a*~22*d*) disposed at each corner of the ceiling panel (10) further comprise a pair of slits (28*a*, 28*b*) on each side skirt portion (16) for inserting the common subordinate decorative object (50) via cross-borders of four neighbored ceiling panels (10).

8. The ceiling panel system as claimed in claim 1, wherein said side triangular cutout holes (22*e*~22*h*) disposed at middle of each side of the ceiling panel (10) further comprises a pair of slits (28*a*, 28*b*) on the skirt potions (16) for inserting the common subordinate decorative object (50) via cross-borders of the neighbored ceiling panels (10).

9. The ceiling panel system as claimed in claim 1, wherein the skirt portions (16) of the neighbored ceiling panels (10) are provided with a plurality of fastener rivet heads (30) for hanging on the clip bars (110).

10. The ceiling panel system as claimed in claim 1, wherein said clip bars (110) are attached under the joint clips (130) and said carrying channels (120) are inserted through the joint clips (130) for assembling together, said clip bars (110) further consisting of a lug (118), a pair of elastic clamping hangers (112, 114) and pair of hooks (132).

* * * * *